United States Patent [19]

Hanmer

[11] 4,260,453

[45] Apr. 7, 1981

[54] POLYMER-BONDED CROCIDOLITE ASBESTOS DIAPHRAGMS AND METHOD FOR FORMING SAME

[75] Inventor: Richard A. Hanmer, Lake Jackson, Tex.

[73] Assignee: The Dow Chemical Company, Midland, Mich.

[21] Appl. No.: 70,182

[22] Filed: Aug. 27, 1979

[51] Int. Cl.[3] ..... C25B 13/06

[52] U.S. Cl. ..... 162/105; 162/155; 204/295; 428/421; 429/217

[58] Field of Search ..... 204/296, 295; 162/155, 162/169, 217, 106, 105; 156/62.2; 429/217; 428/421, 444

[56] References Cited

U.S. PATENT DOCUMENTS

| | | | |
|---|---|---|---|
| 3,097,990 | 7/1963 | Holly | 162/155 |
| 4,093,533 | 6/1978 | Beaver et al. | 204/295 |

*Primary Examiner*—Michael W. Ball

*Attorney, Agent, or Firm*—W. J. Lee

[57] ABSTRACT

Thermoplastic dispersions of fluoropolymers are intimately mixed with an aqueous slurry of crocidolite asbestos at very low pH, the resulting aqueous slurry mixture is formed into diaphragms for use in a chlor-alkali electrolytic cell while being de-watered, and heat-bonded.

11 Claims, No Drawings

POLYMER-BONDED CROCIDOLITE ASBESTOS DIAPHRAGMS AND METHOD FOR FORMING SAME

BACKGROUND OF THE INVENTION

In U.S. Pat. No. 4,093,533, which is incorporated herein by reference, it is taught that chrysotile asbestos fibers are relatively easily bonded together with polymeric fluorocarbons, but that crocidolite asbestos fibers are not readily bonded together with polymeric fluorocarbons to form strong diaphragms for use in chloralkali electrolytic cells (see, e.g., Col. 2, lines 62–67 of the patent).

It has now been found that polymeric fluorocarbons can be made to readily bond crocidolite asbestos fibers into a strong diaphragm for use in chloralkali electrolytic cells by lowering the pH (to about 2 or lower) of the aqueous slurry which contains the particulate polymer and asbestos fibers, then proceding with the diaphragm formation.

SUMMARY OF THE INVENTION

An aqueous slurry of intimately mixed crocidolite asbestos fibers and fine particle polymeric fluorocarbon (also referred to as "fluoropolymer") is acidified to a pH of about 2 or lower. The highly acid slurry is then drawn, cast, or de-watered into the desired diaphragm shape, then further dried and heat-bonded by the application of heat, such as in an oven.

DETAILED DESCRIPTION OF THE INVENTION

The crocidolite asbestos fibers are preferably about ¼ inch or more in length and the fiber bundles, as normally mixed, have been refined to open the bundles. Commerically available refined crocidolite asbestos is suitable for use in the present invention.

The asbestos fibers are slurried in an aqueous medium and sufficient acid is added to lower the pH to about 2 or lower. If the subsequent mixing with fluoropolymer dispersion causes an increase in the pH to much above about 2, it is advisable to add enough more acid to lower the pH again to about 2 or lower. Alternatively the asbestos fibers and fluoropolymer may be mixed together before the pH adjustment by the addition of acid. Other acids, besides HCl, will lower the pH and would be operable, but HCl is clearly the preferred acid because it is readily available, is inexpensive, and because it introduces only ions with are normally found in chloralkali electrolytic cells.

The fluorocarbon polymers may be solid, particulate polymers or copolymers of tetrafluoroethylene, trifluoroethylene, vinylidene fluoride, vinyl fluoride, monochlorotrifluoroethylene, or dichlorodifluoroethylene or may be fluorinated ethylene/propylene copolymer commonly known as FEP. Also, a copolymer of ethylene/chlorotrifluoroethylene sold under the tradename Halar® may be used. Preferably the fluorocarbon polymer is polyvinylidene fluoride, fluorinated ethylene/propylene copolymer, or polytetrafluoroethylene. Most preferably, the fluorocarbon polymer is polyvinylidene fluoride.

The asbestos slurry may also contain minor amounts of processing aids such as surfactants, wetting agents, or dispersing agents, or modifiers, such as inorganic metal compounds, e.g., $TiO_2$, $CaCO_3$, $MgCO_3$, MgO, CaO, etc. Such processing aids or modifiers may be employed in order to help disperse the fluorocarbon polymer and the asbestos fibers uniformly in the aqueous medium and to impart certain porosity features to the diaphragm.

The fluorocarbon polymer aqueous slurries or dispersions may be commercially available (e.g., Kynar®) and generally contain such processing aids or modifiers as stabilizers, surfactants, dispersing agents, etc. Such polymer dispersions may also be prepared for use in the present invention by dispersing fine particle polymer in an aqueous medium by using wetting agents, surfactants, dispersing agents, or stabilizers which help to disperse the fluorocarbon polymers and/or stabilize such dispersions.

The asbestos and fluorocarbon polymer slurry is preferably deposited on the desired porous cathode structure by being vacuum-drawn. By "vacuum-drawn" it is meant that a slurry of the diaphragm ingredients (asbestos, polymer, modifiers, etc.) is contacted with one side of a porous cathode as "vacuum" (reduced pressure) is applied to the other side to pull the solids tightly into place against the cathode while pulling the liquid on through.

Other methods of depositing the diaphragm onto the cathode include the use of gravity flow or positive pressure to force the dispersion against a porous surface, thereby depositing the solids in the form of a matte or web while the liquid flows on through the porous surface. The matte or web of diaphragm material may be prepared on a surface other than the cathode surface (such as by using a Fourdrinier process) and then transferred to the cathode surface.

The following procedures and examples are illustrative of the present invention, except for those identified as being "comparative". Other embodiments of the present invention will become apparent to practitioners of the art and the present invention is limited only by the claims attached hereto.

In general, the preferred method of preparing the present diaphragms for use in an electrolytic process wherein an aqueous NaCl solution is electrolyzed to produce chlorine, hydrogen, and sodium hydroxide is as follows:

1. The crocidolite fibers and fine particle size polymeric fluorocarbon are intimately admixed and slurried in an aqueous media. The aqueous slurry also contains any modifiers, surfactants, etc. which are desired. The amount of fluorocarbon polymer employed may be from about 5 parts to about 100 parts per hundred parts of asbestos; the preferred amount is about 10 to 50 parts with about 15–40 parts being most preferred. Enough acid (e.g., HCl) is added to lower the pH to about 2 or lower.

2. The slurried ingredients are deposited on the foraminous cathode to the desired weight generally about 0.2 gms. to about 2.0 gms. per $in^2$., and dried. Preferably, the weight is about 0.6 to about 0.8 gms./$in^2$.

3. The so-coated cathode is subjected to a sufficient amount of heat to cause sintering or fusing of the polymer particles in the mixture; pressure may be applied, if desired, either by placing a positive force against the diaphragm or by using a vacuum (reduced pressure) on the other side of the foraminous cathode which will draw the diaphragm tightly against the cathode during the sintering operation. The amount of heat will depend, to a large extent, on which polymeric fluorocarbon is being used; the sintering temperature (or softening temperature) of the desired polymer is easily determined experimentally or is available in the publications.

4. The diaphragm-covered cathode is placed into position in the electrolytic cell and, in some cases, is "pre-wetted" by being soaked with a water-soluble wetting agent, such as, detergent, surfactant, methanol, or acetone to make the diaphragm less hydrophobic. Then it is generally flushed with water, anolyte, or brine after which the cell is filled with brine and is ready for the electrolytic process to begin. The "pre-wetting" is done for those polymeric fluorocarbons which exhibit a high degree of hydrophobicity or resistance to wetting, such as polytetrafluoroethylene.

In those cases in which relatively low bonding temperatures may be used, wetting agents present in the pregnant slurry may survive the bonding without appreciable degradation and may therefore aid in the initial "wetting-out" of the diaphragm when put into service in a chlor-alkali cell. When relatively high bonding temperatures are needed, such as with polytetrafluoroethylene, surfactants in the pregnant slurry may be thermally degraded and it may be advisable to employ a wetting agent or a "wetting-out" step for the diaphragm at the outset of its service in a chloralkali cell.

The electrolytic cell is the diaphragm type commonly used for electrolysis of brine to produce chlorine, caustic, and hydrogen. Historically, the diaphragm has been made of asbestos, the anode has been made of graphite, and the cathode has been made of iron or steel. The diaphragm is positioned between the cathode and the anode and electric current flows through the electrolyte (brine). The porosity of the diaphragm is important in that there must be some water-permeability without having so much permeability that the caustic in the catholyte flows freely into the anolyte. It is within the skill of practitioners of the chlorine cell art to adjust the porosity of the asbestos diaphragms to obtain optimum results for their particular operation.

The following example is to illustrate an embodiment of the invention, but the invention is not limited to the embodiment shown.

EXAMPLE

A diaphragm is prepared for use in a chloralkali test cell as follows:

A dispersion of polyvinylidene fluoride powder (Kynar®) is prepared as a 20% dispersion in water, containing a small amount of surfactant.

Crocidolite asbestos (Type 713 from the North American Asbestos Company) is mixed at about 15 to 30 gms. per liter of $H_2O$ to form a dispersion. Less asbestos per liter may be used if less viscosity of the slurry is desired or more asbestos per liter may be used if a highly viscous paste is desired.

The polymer dispersion and asbestos slurry are intimately and thoroughly mixed and enough HCl is added to lower the pH to below 2 thereby allowing the polymer to attach to the asbestos and cause it to be heat-bondable. Prior to heat-bonding care should be taken to prevent the pH from rising to above about 2, as this could cause the polymer to detach from the asbestos.

The resulting slurry is substantially uniformly deposited onto a 10-gauge, 36 $in^2$., perforated steel plate cathode by vacuum-filtration in an amount to provide about 0.8 gms./$in^2$. of polymer/asbestos matte with the weight ratio of polymer/asbestos being about 40/60. The so-coated cathode is dried and baked in an oven at about 165° C. for about 45 to 60 minutes.

After being cooled, the diaphragm is examined by physical manipulation and is found to be well bonded.

The diaphragm-covered cathode is installed in a small laboratory chlor-alkali electrolytic test cell to evaluate diaphragm integrity and operability. After 60 days of operation at an anolyte pH in the range of about 3.5 to about 4.5 the cell is found to be operating efficiently and the diaphragm exhibits no indication of failure or loss of integrity and remains well-bonded.

In similar manner in accordance with this invention, fluoropolymers are found to be effective bonding agents for crocidolite asbestos over a relatively wide range of weight ratios of polymer/asbestos. The ratio may be from about 70/30 to about 2/98, preferably about 30/70 to about 50/50, most preferably about 40/60.

It is critical that the polymer-asbestos slurry be kept at of pH of about 2 or lower prior to diaphragm formation and heat-bonding because at higher pH's the fluoropolymer apparently does not "attach" well to the crocidolite asbestos and when heated in an oven to fuse the polymer, the polymer does not fuse to, or wet, the asbestos fibers and a strong bonded diaphragm does not result.

I claim:

1. A method for preparing a polymer-bonded crocidolite asbestos sheet material, said method comprising, preparing an aqueous mixture consisting essentially of crocidolite asbestos fibers and fine particle size fluoropolymer with enough acid added to attain a pH of about 2 or lower, forming and de-watering the slurried materials into the desired sheet structure, and heat-bonding the sheet structure by applying sufficient heat to heat-plastify, fuse, or sinter the fluoropolymer.

2. The method of claim 1 wherein the weight ratio of polymer/asbestos is in the range of about 70/30 to about 2/98.

3. The method of claim 1 wherein the weight ratio of polymer/asbestos is in the range of about 30/70 to about 50/50.

4. The method of claim 1 wherein the weight ratio of polymer/asbestos is about 40/60.

5. The method of claim 1 wherein the acid is HCl.

6. The method of claim 1 wherein the fluoropolymer is at least one selected from the group comprising polymers and copolymers of tetrafluoroethylene, trifluoroethylene, vinylidene fluoride, vinyl fluoride, monochlorotrifluoroethylene, dichlorodifluoroethylene, and fluorinated ethylene/propylene copolymers.

7. The method of claim 1 wherein the fluoropolymer comprises a polymer or copolymer of vinylidene fluoride.

8. The method of claim 1 wherein the slurry contains surfactant material.

9. The method of claim 1 wherein the slurry contains dispersion stabilizers, dispersing aids, wetting agents, and/or inorganic pore formers.

10. The method of claim 1 wherein the sheet material is formed as a diaphragm structure by vacuum-depositing the polymer/asbestos mixture onto a foraminous electrolytic cell electrode, said vacuum-depositing providing substantial de-watering of the polymer/asbestos mixture, and subjecting the structure to sufficient heat to dry and heat-bond the mixture.

11. The heat-bonded sheet material prepared according to claim 1.

* * * * *